US011155967B2

(12) United States Patent
Coats

(10) Patent No.: US 11,155,967 B2
(45) Date of Patent: Oct. 26, 2021

(54) SWING TURNOUT FOR RAILROAD TRACKS AND METHOD FOR PROVIDING A TURNOUT

(71) Applicant: PANDROL LIMITED, Surrey (GB)

(72) Inventor: Frank Howard Coats, Thorofare, NJ (US)

(73) Assignee: Pandrol Limited, Addlestone (GB)

( * ) Notice: Subject to any disclaimer, the term of this patent is extended or adjusted under 35 U.S.C. 154(b) by 250 days.

(21) Appl. No.: 16/093,382

(22) PCT Filed: Apr. 13, 2017

(86) PCT No.: PCT/US2017/027308
§ 371 (c)(1),
(2) Date: Oct. 12, 2018

(87) PCT Pub. No.: WO2017/180806
PCT Pub. Date: Oct. 19, 2017

(65) Prior Publication Data

US 2019/0127921 A1 May 2, 2019

Related U.S. Application Data

(60) Provisional application No. 62/321,979, filed on Apr. 13, 2016.

(51) Int. Cl.
*E01B 7/06* (2006.01)

(52) U.S. Cl.
CPC ..... *E01B 7/06* (2013.01)

(58) Field of Classification Search
CPC ..... E01B 7/06; E01B 7/00; E01B 7/02; E01B 7/04; E01B 7/08; E01B 7/14; E01B 7/18;
(Continued)

(56) References Cited

U.S. PATENT DOCUMENTS 234,436 A * 11/1880 Solt ..... E01B 7/06 246/447
745,199 A 11/1903 Koch
(Continued)

FOREIGN PATENT DOCUMENTS

CA 1055783 6/1979
CN 201023490 2/2006
(Continued)

OTHER PUBLICATIONS

International Search Report and Written Opinion, United States Patent and Trademark Office, Application No. PCT/US2017/027308, dated Jul. 17, 2017.
(Continued)

*Primary Examiner* — Mark T Le
(74) *Attorney, Agent, or Firm* — Gottlieb, Rackman & Reisman, PC

(57) ABSTRACT

A swing railroad turnout that includes a railroad track with a mobile portion and actuators that are used to selectively bend the mobile portion between a first and a second position. In the first position, connection is made to a first track. In the second position, connection is made to a second track. The tracks are formed of rails that are supported on ties or other fixed foundations. The rails are either bent with respect to the ties, or the ties themselves are moved generally transversely to bend the rails. Connecting mechanisms are provided for selective connection of the rail ends.

23 Claims, 15 Drawing Sheets

(58) Field of Classification Search
CPC ..... E01B 25/06; E01B 25/12; E01B 25/15; E01B 25/20; E01B 25/26
See application file for complete search history.

(56) References Cited

U.S. PATENT DOCUMENTS

| | | | | |
|---|---|---|---|---|
| 3,093,090 | A * | 6/1963 | Rosenbaum | E01B 25/12 104/130.11 |
| 3,472,176 | A * | 10/1969 | Lamartine | E01B 25/12 104/130.11 |
| 4,093,163 | A * | 6/1978 | Larsson | B61L 7/061 246/220 |
| 4,109,584 | A | 8/1978 | Mihirogi | |
| 4,476,787 | A | 10/1984 | Edwards | |
| 4,534,527 | A * | 8/1985 | van Eyken | E01B 7/00 246/445 |
| 4,774,891 | A | 10/1988 | Coester | |
| 5,547,161 | A | 8/1996 | Giras et al. | |
| 5,657,696 | A * | 8/1997 | Bishop | B61L 5/00 104/130.05 |
| 6,000,624 | A * | 12/1999 | Marron | E01B 11/28 238/174 |
| 6,499,409 | B1 | 12/2002 | Niederer et al. | |
| 8,020,493 | B2 | 9/2011 | Blum | |
| 2010/0072327 | A1 | 3/2010 | Song | |

FOREIGN PATENT DOCUMENTS

| | | | | |
|---|---|---|---|---|
| CN | 200999053 | | 1/2008 | |
| CN | 201525390 | | 7/2010 | |
| CN | 203113170 | | 8/2013 | |
| DE | 30 04 406 | | 8/1981 | |
| EP | 1 860 238 | | 11/2007 | |
| WO | WO-0121894 | A1 * | 3/2001 | E01B 25/26 |

OTHER PUBLICATIONS

Smart Train, Sommee.com, Sep. 2005, http://www.formatc.somee.com/robosmarttrain1.asp.
Pneumatic Control Switch Device, Mar. 19, 2016, http://www.dongdamachinery.com/product/transportation/28.html.
Types of Railway Turnouts and Their Components, Agico Group, Mar. 19, 2016, http://www.rail-fastener.com/railway-turnout-introduction.html.

* cited by examiner

SWING TURNOUT FOR RAILROAD TRACKS AND METHOD FOR PROVIDING A TURNOUT

FIELD OF THE INVENTION

The present invention pertains generally to railroad tracks and more specifically to a railroad turnout in which tracks are swung in a curve to selectively connect to other tracks and a method of swinging or bending the tracks for a turnout.

BACKGROUND OF THE INVENTION

While many transportation options are available for moving people and cargo, railroads continue to be a widely used means for transportation, especially for cargo. One of the crucial components of any railroad system is the turnouts that allow trains to switch from one track to another. The structures of turnouts have been unchanged for many years and consist of solid, rigid rail sections terminating in narrow points. These sections are pivoted a short distance (in the range of a couple of inches) one way or another, as required. Originally, rail sections were moved by hand-operated levers. In modern installations, rail sections are moved using pneumatic cylinders that are controlled remotely.

As track layouts get more and more complex, especially at busy intersections, stations or yards, the number of turnouts used in a rail system continues to rise. Turnouts are rather cumbersome, complicated mechanical structures that are subject to extensive wear and tear, especially when used for very heavy freight. As such, they must be maintained properly at regular intervals, otherwise they can fail and cause accidents that may result in very serious injuries or deaths, damage to cargo, tracks and the rolling stock, and cause considerable delays. In fact, a significant portion of railroad accidents involve a malfunction or breakdown of turnouts.

Conventional turnouts require car wheels to cross a gap in the rail or alternatively roll briefly on their flanges. This commonly causes severe wear and tear to the wheels and tracks, degradation to the ballast supports due the repeated impact on the wheels and generates unwanted noise. Another problem with conventional turnouts is a signal dead zone, which is a discontinuity in the electrical signal control system that the present invention can eliminate. Further, train speed through conventional turnouts is adversely affected by lack of rail superelevation or "banking". The present invention provides an improved ability to provide superelevation.

Thus, there is a need for a turnout that is simpler, maintains normal wheel contact, is more reliable, especially when used for very heavy cargo, is easy to control and operate, and offers potential for increased speed.

SUMMARY OF THE INVENTION

In an embodiment, a railroad turnout for selectively connecting a first track to one of a second track and a third track, is provided with each track including rails with rail ends. The turnout includes a mobile track portion that has mobile rails forming a continuation of the first track rails at all times and terminates in first rail ends. Actuators are also provided that are configured to bend the mobile track portion between a first position and a second position. In the first position, the first rail ends abut the second rail ends and in the second position, the first rail ends abut the third rail ends.

The mobile track portion can be disposed on supports, securing the mobile rails to a plurality of ties. In an embodiment, the ties are fixed and the supports and are configured to move with respect to the ties as the mobile track is bent between the first position and the second position. In another embodiment, the ties are configured to move with the mobile track portion.

In an embodiment, a trough is disposed below the mobile track portion and at least one actuator is disposed in the trough.

In an embodiment, a lifting device is provided that is configured to selectively lift at least one of the mobile rails. The lifting device is provided for banking, to compensate for elevational changes between tracks, and/or to move rails with respect to supports. The lifting device may be fixed or may be disposed on a track that roles to selectively bend one or both of the mobile rails laterally.

The mobile rails can have an I-shaped cross-section, a T-shaped cross-section, or a short section of their ends may be cut off longitudinally. This latter configuration may be used with a rider rail bridging the rail ends.

A plurality of connections are provided for connecting one of the mobile rail ends to one of the ends of the second or third track. Each connection can include a pin and cavity arrangement for aligning the respective railroad ends. Each connection can include a boss on one of the rail ends and an extendible cylinder-and-piston assembly associated with the other of the rail ends. The cylinder-and-piston arrangement is configured to selectively engage the boss and pull the rail ends toward each other.

In an embodiment, a railroad turnout is provided for selectively connecting the first and second rail of a first track, respectively, to one of the first and second rail of a second and third track with the rails of the second and third track have respective second and third track rail ends. The turnout is formed of a mobile track section that includes a first mobile rail and a second mobile rail. The first and second mobile rails form continuous extensions of the first and second rails of the first track and terminate in mobile rail ends. The mobile track section has a first and a second position. In the first position, the mobile rail ends abut the second track rail ends and in the second position, the mobile rail ends abut the third track rail ends. Actuators are included to bend the first and second mobile rails from the first to the second and from the second to the first positions. A controller is used to control the actuators and other elements of the swingout such as cylinders for raising the rails.

In an embodiment, the first track is selectively connected to three or more other tracks by bending the mobile track section by an appropriate arc in one direction or the other.

In an embodiment, both the first track and the third track have mobile sections that are bent toward each other to connect the respective tracks.

In an embodiment, rods or other stiff members are connected between the rails of the mobile track section to maintain the rails at a nominal distance at least in the first position and the second position to ensure that trains can cross the mobile track section without derailment.

DETAILED DESCRIPTION OF EMBODIMENTS OF THE INVENTION

Figure 1:
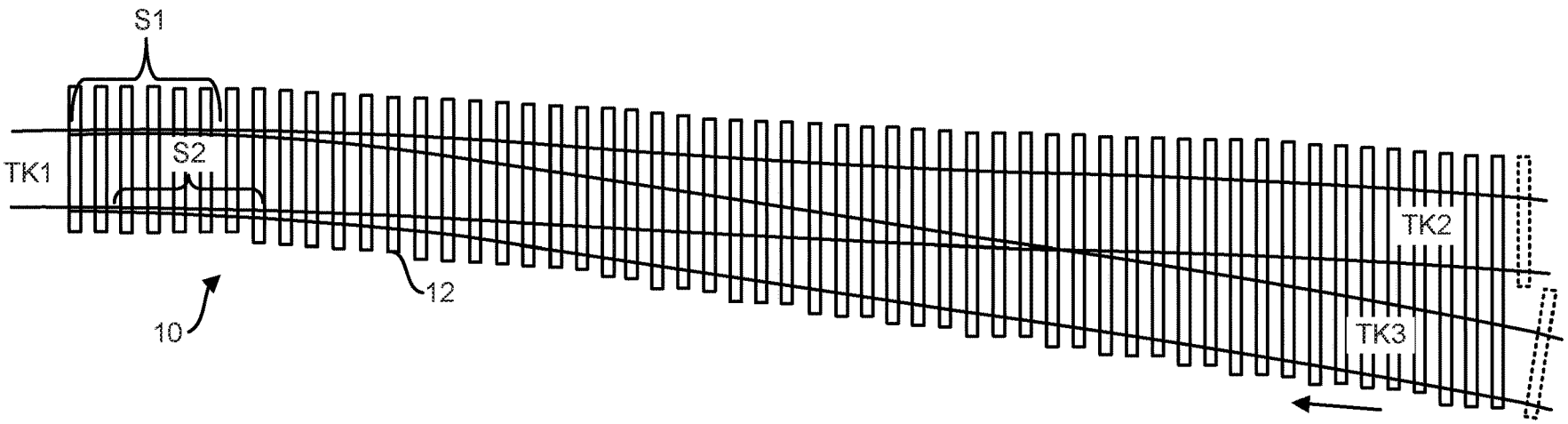
(PRIOR ART) FIG. 1
FIG. 1 shows a known track layout with a standard turnout for switching trains between two tracks.

Referring now to FIG. 1, a known track layout 10 is shown that includes a first track TK1, a second track TK2 that is a linear to the first track TK1 and a third track TK3 that is disposed at an angle (conventionally called a "frog angle") with respect to the first TK1. Rails are affixed to and supported by conventional ties 12 to the first track TK1, the second track TK2 and the thirds track TK3. At the intersection of the first track TK1 and the third track TK3, two separate segments S1 and S2 are provided that can be shifted laterally between a first position and a second position. In the first position, trains can move in either direction along the first track TK1 and the second track TK2. In the second position, trains can move in either direction along the first track TK1 and the third track TK3. The segments S1 and S2 are moved using various mechanical means actuated manually or otherwise. Importantly, if the segments S1, S2 are blocked from moving or malfunction for any reason, trains going in either direction a first direct A or a second direction B along the tracks TK1, TK2, TK3 can derail.

Figure 2:
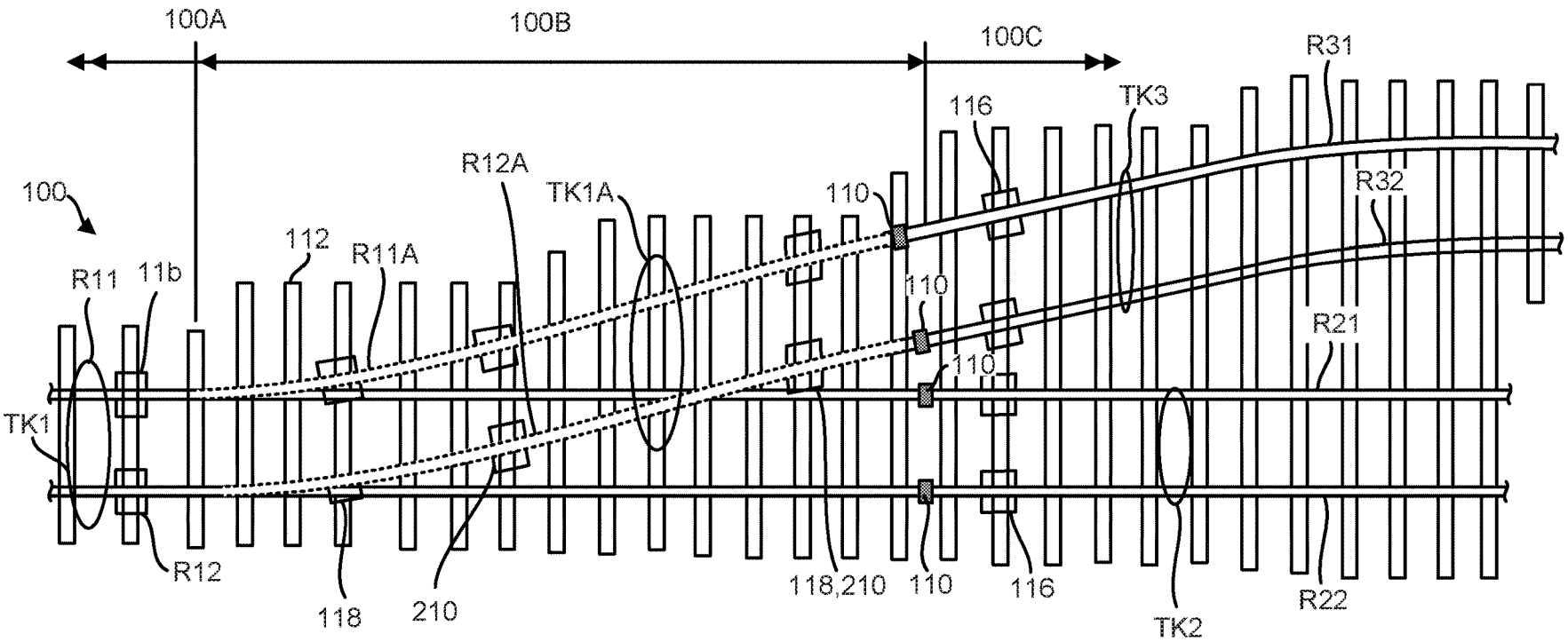
FIG. 2 shows a diagrammatic plan view of an embodiment of a track layout of the present invention with a swing turnout for switching trains between two tracks.

FIG. 2 shows an embodiment of a layout of a turnout 100 ("Swing Turnout") of the present disclosure. The turnout 100 is a vast improvement over existing turnouts because it does not have separate sections that are shifted as discussed above or gaps that wheels of a train must cross. Instead the rails of one of the tracks are selectively bent from a straight shape (in which they are connected to a second set of rails) to a curved shape (in which they are connected to a third set of rails). More particularly, the turnout 100 has three sections. Namely, a first section 100A, a second section 100B and a third section 100C. The first section 100A consists of a first portion of track TK1 that is stationary. The second section 100B consists of a portion of track TK1A that is continuous with the first portion of track TK1. In one configuration, the first track TK1 is linear with the portion of track TK1A and its ends are connected to the second track TK2. As described in more detail below, this portion of track TK1A is bent to a curved configuration in which its ends are connected to the third track TK3. The third section 100C is formed from the second track TK2 that is linear with the first track TK1 and the third track TK3 that is disposed at a frog angle 140 with respect to the second track TK2.

As shown in more detail in FIG. 2, the first, second and third tracks TK1, TK2, TK3 are each defined by rails R11, R12; R21, R22; and R31, R32, respectively. At a given time, the rails R11 and R12 of the first track TK1 are aligned with the rails R21 and R22 of the second track TK2 thereby allowing trains to go from the first track TK1 to the second track TK2, or vice versa. Then, when a switch is required, respective segments R11A and R12A of the rails R11 and R12, respectively, of the first track TK1, which originally abut the ends of the rails R21, R22, respectively, of the second track TK2 are gently bent into respective curved configurations so their ends abut the respective ends of the rails R31, R32 of the third track TK3 as shown. Once the switching occurs, trains can go back and forth between the first and second tracks TK1 and TK2. Then at a later time, when needed, the segments are bent back from the curved to the straight position. Importantly, segments R11A, R12A are solid extensions and are integral with the rails R11, R12 of the first track TK1 and the only physical break between the rails R11, R12 occur at the butt joints or couplings 110.

It should be understood that FIG. 2 is diagrammatic showing the rail configurations of the tracks and that various equipment for bending the rails, changing their elevation, joining the abutting rail ends and other functions have been omitted for the sake of clarity.

Figure 3A:
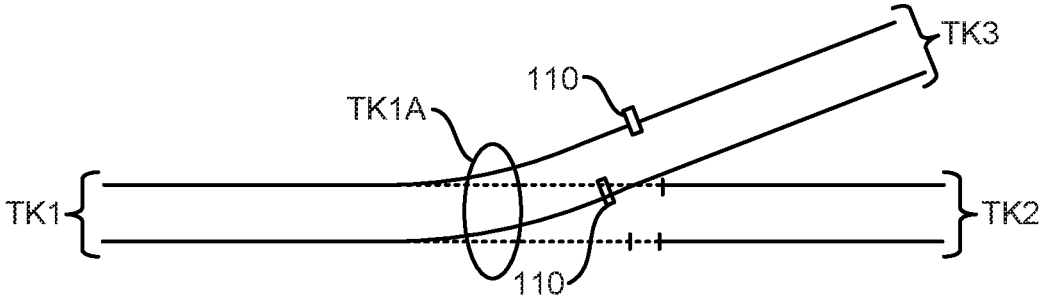
FIGS. 3A-3E show enlarged views of various track layouts using the technique illustrated in FIG. 2.
Figure 3B:
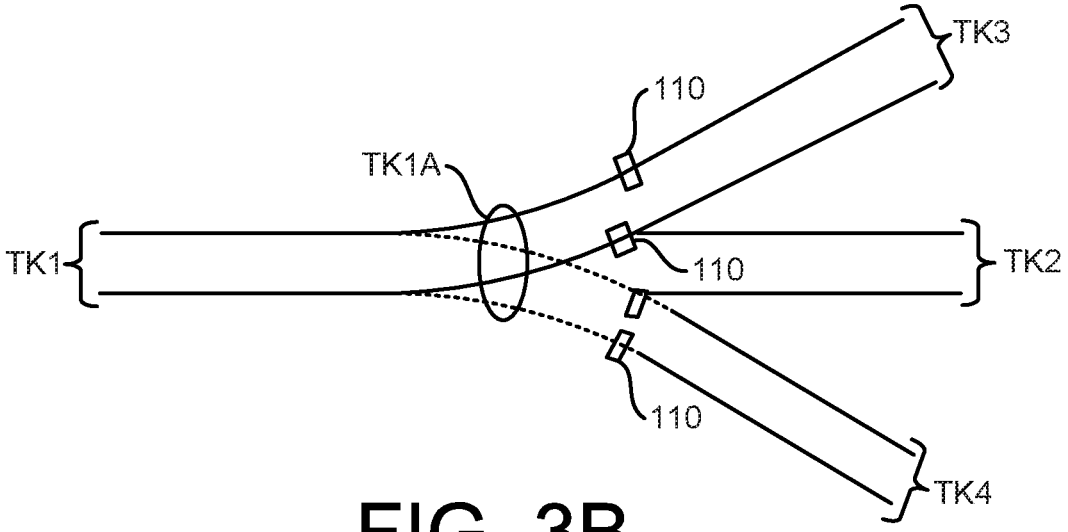
Figure 3C:
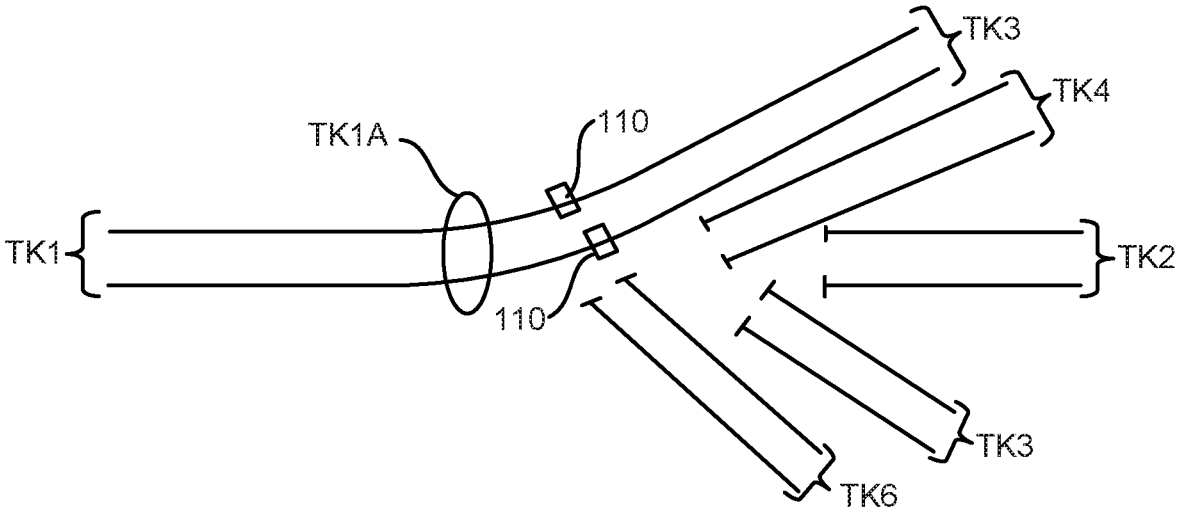

Moreover, the general principles illustrated in FIG. 2 can be extended to various configurations, such as the ones shown in FIGS. 3A-3D. In FIGS. 2 and 3A, the first and second tracks TK1 and TK2 may be part of a main track and the third track TK3 may be a side track. In FIG. 3B, a similar configuration in shown in which the first track TK1 can be selectively connected to a main track section TK2, a first side track TK3 disposed on one side of the TK2 and a second track TK3 disposed on the other side of track TK2. In FIG. 3C, the first track TK1 can be selectively switched to any of the second track TK2, the third track TK3, a fourth track TK4, and a fifth track TK5. The difference between the switching to the third track TK3 and the fourth track TK4 is the length of the portion of track TK1A that has to be bent and its final curvature.

Figure 3D:
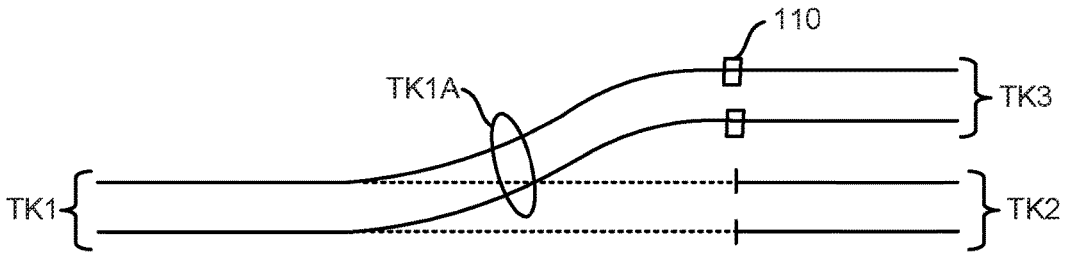

In the embodiments discussed above, the track section TK1A is bent in a simple curve (that is generally an arc of a circle or ellipse). In the embodiment of FIG. 3D, the track section TK1A is bent into a more complex shape, such as an S-shape.

Figure 3E:
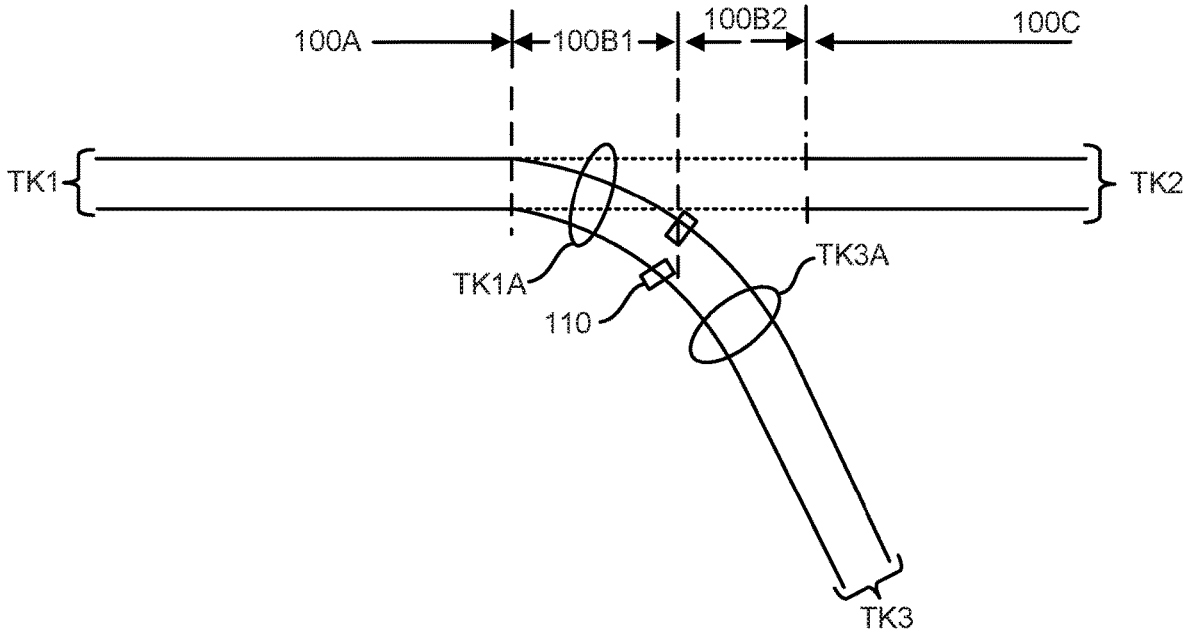

In the embodiments discussed above, only the track section TK1A is bent to join one of two or more stationary rails. In FIG. 3E, the first track TK1 has a section TK1A that is bent and the third track TK3 has a section TK3A that is bent to meet and join track section TK1A of the first track TK1. In other words, the turnout in FIG. 3E has four segments: 100A, 100B1, 100B2 and 100C. In segment 100A, the first track TK1 is stationary. In segment 100B1, track section TK1A is bent between a straight and curved configuration. In segment 100B2, the track section TK3A is selectively bent between a straight configuration in which the third track TK3 is joined to other tracks or is shaped for another other reason, and a curved configuration for joining the ends of track TK1A. This configuration is desirable when the frog angle is very large or when it is desirable to bend a smaller length of rail, for example, to reduce stress on the rail sections.

In the embodiment of FIG. 2, the segments R11A, R12A are supported on stationary ties 112 which are longer than conventional rails to allow the rail segments R11A, R12A to swing back as discussed above. Stationary rails R11, R12, R21, R22, R31, R32 are supported on ties by conventional supports 116. However, in an embodiment, the rail segments R11A, R12A are disposed on modified rail supports 118 that maintain the respective rail segments on the ties, but allow the rail segments to both slide and rotate with respect to the ties so that they can be bent in the shapes shown in FIGS. 3A-3E. For example, these supports 118 may include trucks movable along the respective ties as discussed in more detail below. (In the figures, only some of the supports 116, 118 are shown for the sake of clarity. It is understood that such rail supports are preferably in between every tie 112 and respective rails or rail segments).

Figure 4A:
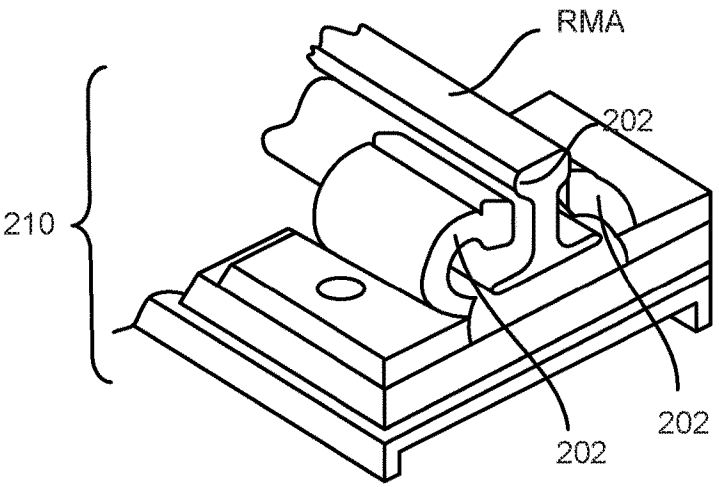
FIGS. 4A and 4B show an orthogonal and an end view of a method of supporting one of the movable or mobile rail segments, respectively, using pads engaging the rail segment web.
Figure 4B:
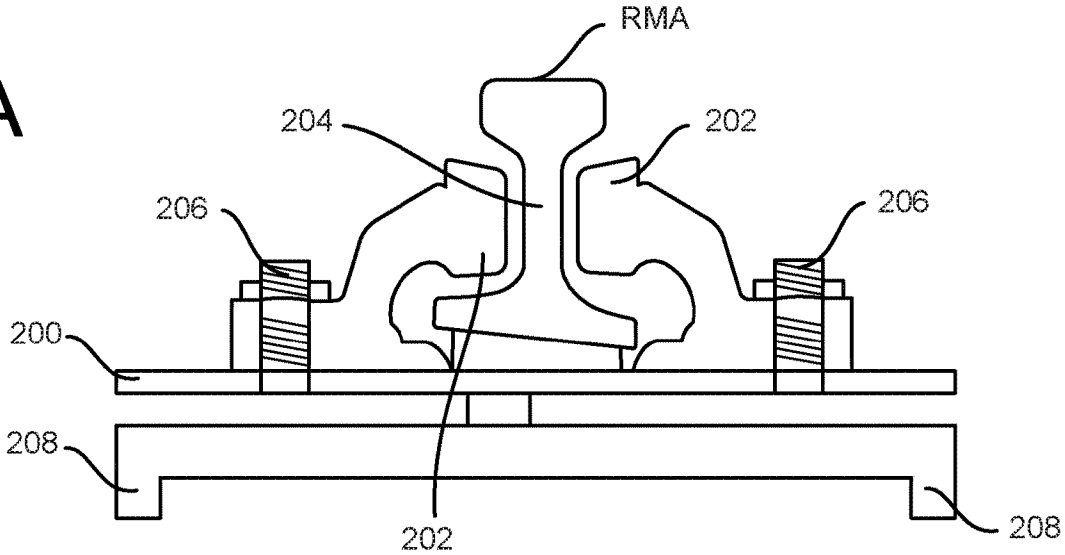

For example, as shown in FIGS. 4A, 4B, each rail R11A, R12A may be mounted on a plate 200 holding two pads 202. The two pads 202 are arranged to hold the web 204 of the respective rail. The pads 202 are affixed to the plate 200 by lugs 206. The pads 202 are spaced to allow the respective rail R11A, R12A to slide longitudinally as the rails are being bent. In turn, the plate 200 is disposed on a platform 208 and is rotatable with respect to the platform 208. The platform is movable longitudinally along a tie 118. The plate 200, pads 202 and platform 208 together form a truck 210 and provide an example for a movable support 118 for the respective rail R11A, R12A. Supports with pads 202 are available from Pandrol of New Jersey, USA, under the name of Panguard®.

Figure 5A:
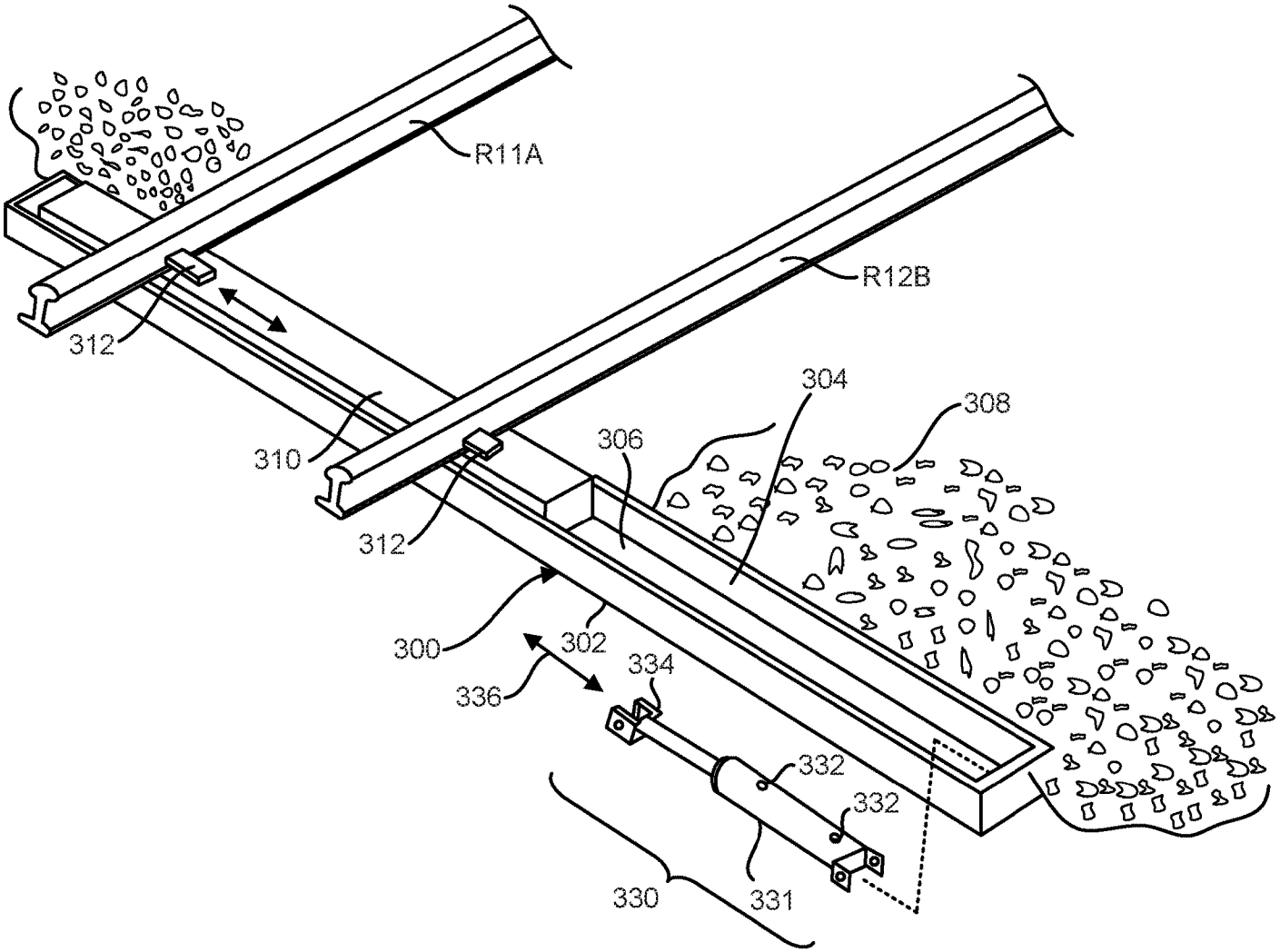
FIG. 5A shows an enlarged orthogonal view of the rail segments supported on a movable tie with the movable tie reciprocated by an actuator.
Figure 5B:
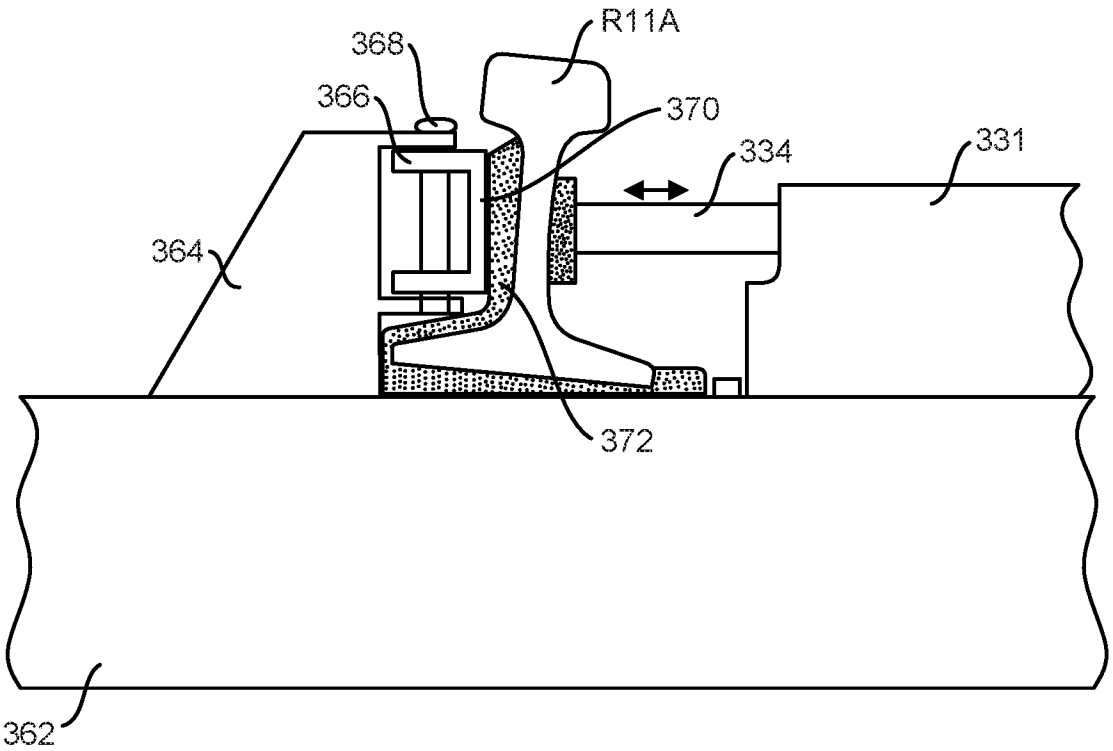
FIG. 5B shows a cross-sectional view of a rail segment supported on a movable tie, with the rail segment bent by an actuator.

FIG. 5 shows an alternate embodiment for movable supporting rails R11A, R11B. In this embodiment, a trough 300 is formed having two longitudinal lateral walls 302, 304 and a bottom 306. The trough 300 is imbedded in a conventional ballast 308. A conventional tie 310 is slidably disposed in the trough and can be moved in one direction or another by actuator 330. The actuator 330 includes a cylinder 331 with two ports 332 and a piston 334 coupled to tie 310. The cylinder is connected to a vacuum source, a liquid source or a gas source through ports 332 to selectively move the piston 334 in one direction or another, as indicated by arrow 336, thereby reciprocating the tie 310 in trough 302. As discussed, the actuator 330 could also be electrically operated.

The tie 310 is made of wood, cement or other suitable material. The rails R11A, R11B are secured to the tie 310 by clamps 312. The clamps 312 are configured to allow the rails R11A, R12A to slide longitudinally and rotate with respect to the tie 310.

In an embodiment as shown in FIG. 5A, the rail R11A rests on a plastic rail guide 360 disposed on a tie 362. A bracket arrangement, including an outer bracket 364 and an inner bracket 366 is also provided. The outer bracket 364 is attached to the tie 362 by welding or other conventional means. The inner bracket 366 is supported by the outer bracket 364 by a pin 368. Inner bracket 366 has an inner face 370 bearing against a portion 372 of guide 360 thereby securing the rail R11A to the tie 362. The actuator 330 with cylinder 331 and piston 334 are positioned above the tie 362 and when actuated, the actuator 330 is operated, piston 334 moves to the left bending the rail R11A. The inner bracket 366 is allowed to rotate with respect to the outer bracket 364 by pivot pin 368 and to slide with respect to the rail guide 360.

Figure 6:
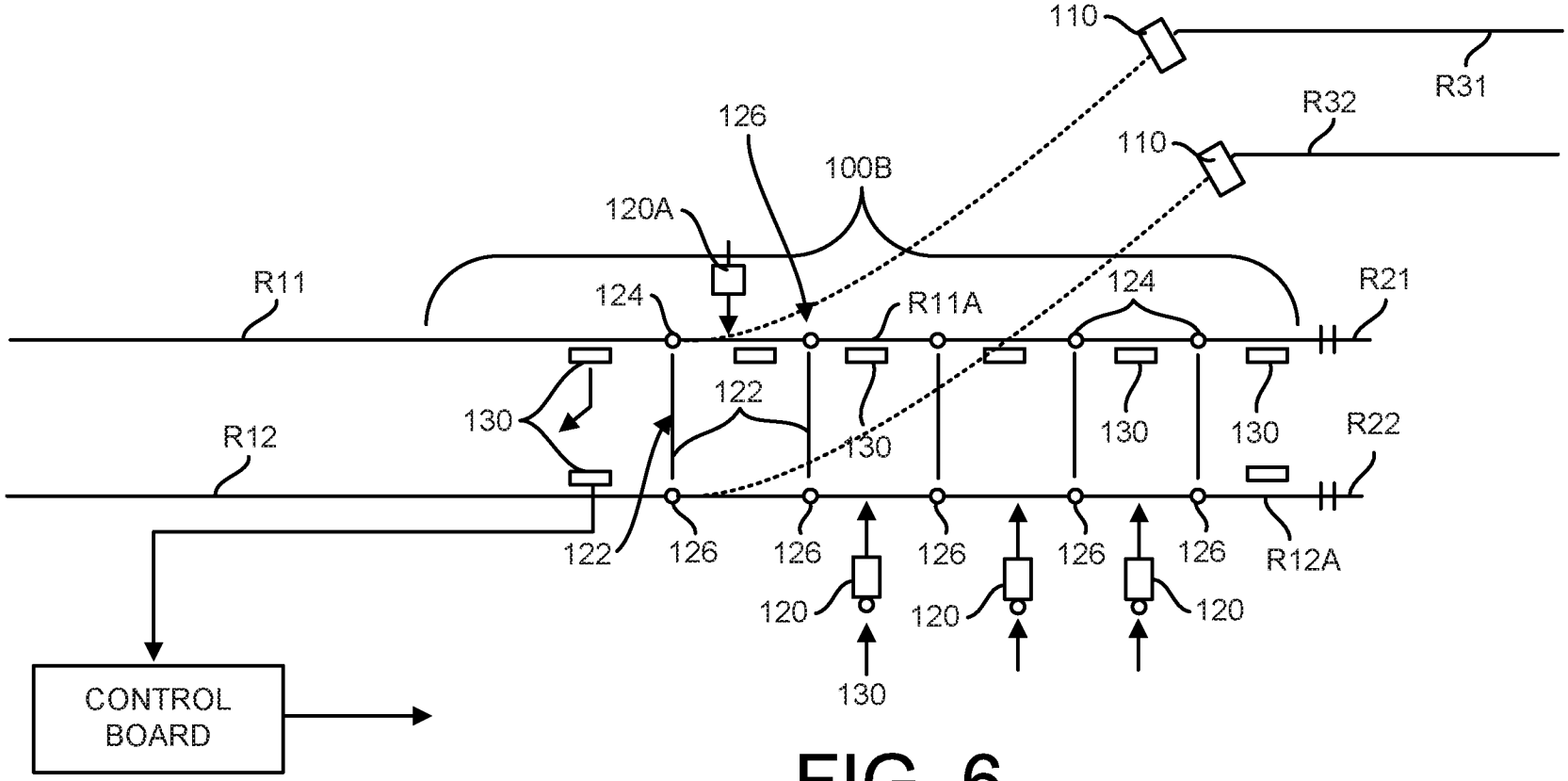
FIG. 6 shows a diagrammatic plan view of the central section of the turnout with actuators for bending the rail segments.

FIG. 6 is diagrammatic plan view of track section 100B with rails R11A, R12A. A plurality of bending mechanisms 120 are provided along these tracks. Each of these mechanisms 120 is arranged and constructed to apply a lateral force on the rails to force them to bend laterally to take on the bent shapes shown in FIGS. 2, 3A-3E. In an embodiment, the mechanisms 120 apply a lateral force only on one rail (in this case R12A). Transversal bars 122 are provided along the track section 100B which perform two functions: (1) they transmit lateral forces to rail R11A to cause the rail R11A to bend as well as described above, and (2) ensure that during this bending process, the nominal spacing or gauge between the rails R11A, R12A remains fixed (either continuously as the rails are bent, or at least in the beginning configuration, e.g. when the rails R11A, R12A are connected to rails R21, R22, and the end configuration in which rails R11A, R12A are connected to rails R31, R32, respectively).

Each bar 122 is coupled to rails R11A, R12A by respective fasteners 124, 126. Importantly, each of these fasteners are configured to allow the respective bar to rotate with respect to each of the rails. In addition, each one or both fasteners 124, 126 are configured to allow the bars to slide with respect to the rails.

In another embodiment, bending mechanisms 120A are also provided to bend the rail R11A as well. In this case, the bars 122 are provided to set the spacing between the rails R11A, R12A as discussed above.

In an embodiment, all the bending mechanisms 120, 120A are controlled from a central control board 150. In addition, motion or position sensors 130 are provided along the rails to monitor their motion and position. The outputs of these sensors are fed to the control board 150. The control board 150 is used to control the operation of the swing turnout 100 by monitoring the positions of the rails and controlling the operation of the bending mechanisms 120, 120A. In this embodiment, it may be possible to eliminate the bars 122 altogether.

There several different kinds of technologies that may be used to implement the bending mechanisms 120, 120A. In its simplest form, the bending mechanism may include, as shown in FIG. 5, a hydraulic cylinder 330 mounted on floor 306 of trough 300. A working fluid is provided to the cylinder 330 via tubes 332 from a pump (not shown) in response to control signals from the control board 150. The piston 334 is reciprocated by the cylinder 330 and is connected to the tie 310 and used to move it back in forth within the trough 300 as indicated by arrow 336.

In an embodiment, the piston is connected directly to the rail(s). This embodiment is especially applicable when the rails move on top of the ties.

Other types of driving engines may be used in addition to hydraulic cylinders, such as pneumatic cylinders, electric motors, etc.

In an embodiment, the bending mechanisms or actuators are reversible so that they can be used to bend the rails in either direction. Alternatively, a first set of actuators are used for to move the rails in a first direction and a second set of actuators are used for to move the rails in the opposite direction.

It is estimated, that 5-10 such bending mechanisms are required per swing turnout, each mechanisms (or actuators) generating about 20,000 lbs. of force in the configurations in which the rails are moved together with the ties, or 2,000 lbs. of force if the rails move on top of the ties.

Figure 4C:
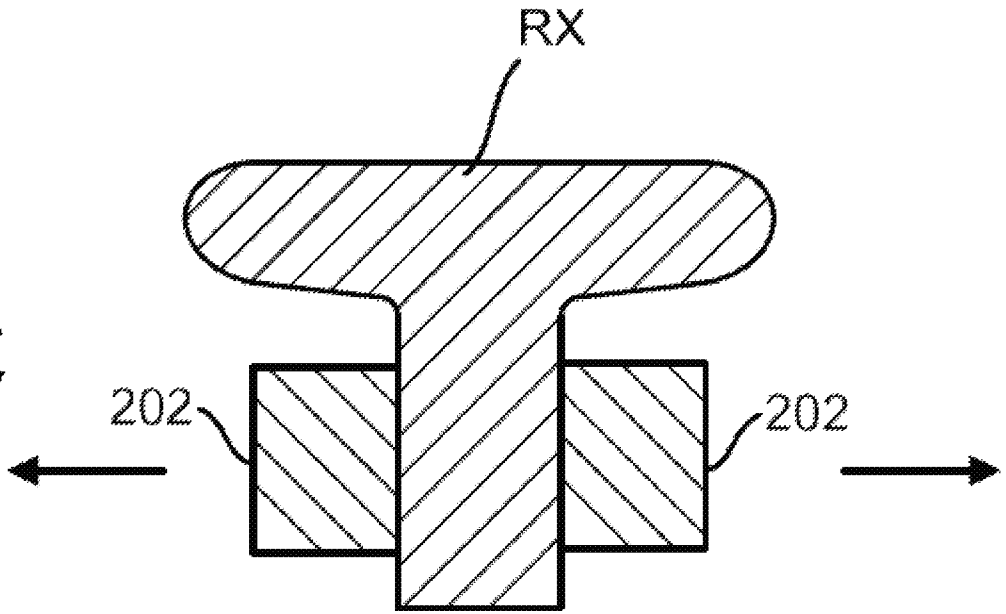
FIG. 4C shows an end view of a modified rail segment having a T-shaped cross-section.

As is clear from the above discussion, the present invention relies on bending rail segments R11A, R12A repeatedly. In an embodiment, normal rail segments having a cross-sectional I-shape may be used for this purpose. Alternatively, modified rails RX may be used that have a T-shaped cross-section as shown in FIG. 4C. The rail segments may be manufactured to have this modified shape RX or a regular piece of I-shaped rail may be modified by cutting off portions of its base to achieve this shape.

As viewed in FIG. 2, 3A-E or 6, at the right side, rails R11A. R12A are mere continuations of respective rails R11, R12. The opposite ends of these rails are selectively connected the respective ends of the rails R21, R22 or R31, R32. In an embodiment, the rail segments are moved so that their ends abut the respective ends of the stationary rails (with possible a small gap therebetween) and no active couplings are required.

Figure 7:
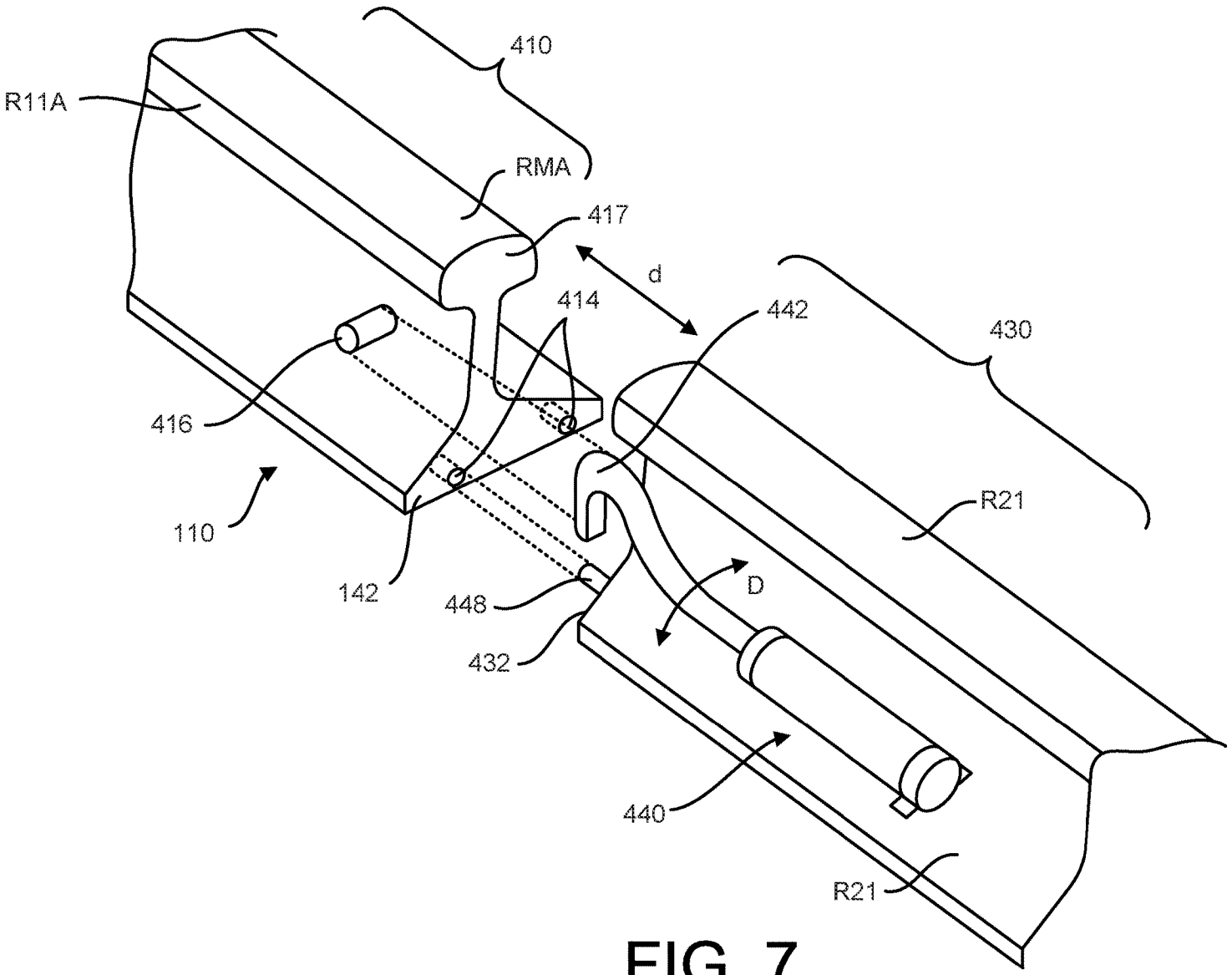
FIG. 7 shows a diagrammatic orthogonal view of a rail segment being connected to a stationary rail using an active coupling.

In another embodiment, active couplings are provided to positively connect the rail ends together. One such active coupling 110 is shown in FIG. 7. The coupling 110 is used to connect the end 410 of rail R11A segment to the end 430 of fixed rail R21. Rail segment 410 has a face 412 and end 430 has a face 432. These two rail surfaces are latched together as follows.

Face 412 is formed with one or more sockets 414. Face 432 is formed with matching or complimentary pins 434 extending generally horizontally.

The rail segment R11A is sized so that when it is in the position shown in FIG. 7, the two faces are disposed at a space d in the range of about 1-3 inches. Preferably, this distance d is slightly larger than the length of pins 148. A latch boss 416 is formed or attached to the web of end 410. The rail end 430 is provided with a horizontally activated hydraulic cylinder 440 terminating with a hook 442. The cylinder 440 may be pivotable slightly up and down, as indicated by arrow D.

Once the rail ends 410, 430 are positioned as shown, the cylinder 440 is activated forcing the hook 442 to advance until it disposed about and engages boss 416. It may be necessary to provide a similar boss/cylinder arrangement on the other side of the rail ends 410, 430. Once the boss 416 is engaged by the hook 442, the cylinder 440 is configured to retract the hook 442. As the hook 442 moves to the right, back into the cylinder 440, it applies a tension on the rail segment R11 and rail R31 causing the rails to move or stretch slightly toward each other. As the faces 410, 430 approach each other, pins 432 enter sockets 414 thereby interlocking the rail ends 410, 430. Assuming there is no dirt or other foreign matter between the faces this action continues until faces 412, 432 contact and abut each other.

The process is reversed by operating the cylinder 440 is operated to release the boss 416 from hook 442. The rail segment R11A and rail R31 contract causing the faces 142, 144 to separate and withdrawing the pins 448 from sockets 414. The cylinders 440 for each active coupling 410 are controlled from control board 150. The segment R11A is now free to be bent toward another rail end. Of course, this configuration is merely one possible means of interconnecting and latching the rails. Many other configurations may be used as well.

Figure 8:
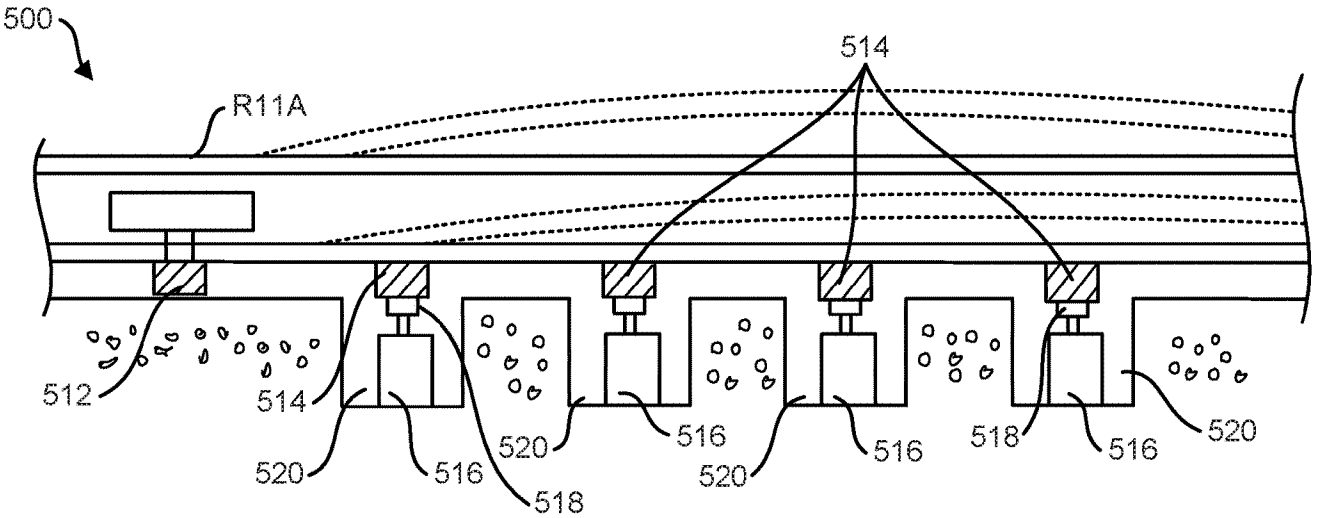
FIG. 8 shows a diagrammatic elevational view of a track being lifted vertically.

In the embodiments described above, the first, second and third rail tracks TK1, TK2, TK3 (or at least the portions shown in the Figures) are essentially horizontal and the segments R11A, R12A are bent in a horizontal plane as well. In another embodiment, at least some portion of one or both the segments R11A, R12A is elevated or dropped to a different vertical level. This action is particularly desirable for banking the rail segments. As a result, the length of the segment could be reduced without increased risk of having a train derailment. FIG. 8 shows an implementation of this concept. In FIG. 8, a system 500 is provided in which rail segment R11A is supported by a stationary tie 512 and a plurality of other ties 514. Ties 514 are supported by hydraulic cylinders 516, each having a platform 518. The hydraulic cylinders are disposed in trenches 520 formed below ground. (Alternatively, the cylinders are disposed in trough 302 of FIG. 5). When the cylinders 516 are inactive, the platforms 518 supporting the ties 514 are in a generally horizontal plane. When the segment R11A is bent laterally, as discussed above, cylinders 516 are also activated causing the platforms 518 to go up and raise a portion of segment R11A in a gentle vertical curve. For this purpose, the platforms 518 are raised to a different respective height. Generally, this height is in the range of one to six inches. When segment R11A is bent back to its original position, the platforms 518 and the ties 514 are lowered to be even with tie 512. This vertical elevation, described above to be provided by other types of mechanisms, including, for example, mechanisms acting between the rail and conventional ties. Rail segment R12A may be raised to a different height or may remain at the same height as tie 512.

A similar arrangement may be used when some of the tracks are vertically offset from others. For example, track TK3 may be higher than tracks TK1 and TK2 and this arrangement can easily accommodate this difference.

In the embodiments discussed so far, cylinders 516 are stationary because they have to lift the respective rails only at specific locations. In an alternate embodiment, the cylinders 516 (or other similar mechanisms) may be mounted on rolling trucks 530 (see FIGS. 8A, 8B) mounted on wheels 532. The trucks 530 are disposed in a trough 520 and can be moved back and forth within the trough 520 by an actuator such as cylinder 330 with reciprocating piston 334.

In this embodiment, rail segment R11A has a T-shaped cross-section, as explained above in conjunction with FIG. 4C, and is supported and secured in place by pads 202. A pivoting mechanism 540 is used to selectively pivot pads 202 between a first position in which the pads engage and hold the web 206 of rail segment R11A and a second position in which the pads 202 are disengaged. The second position may be a small distance away (e.g., a fraction of an inch) from the web 206.

Figure 8A:
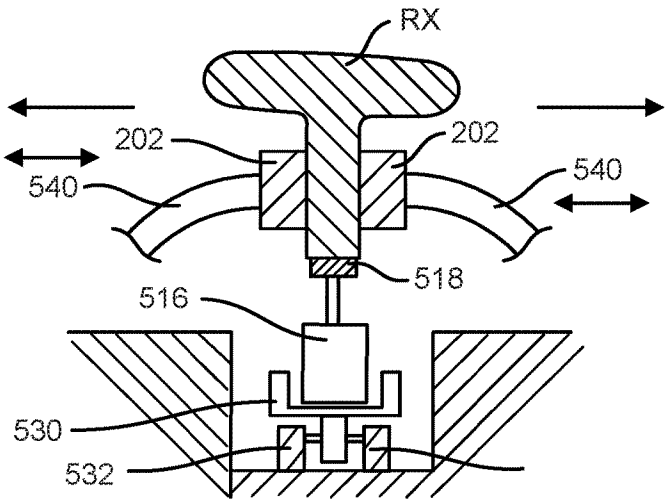
FIG. 8A shows an enlarged end view of a rail segment with T-cross section being lifted by the cylinder illustrated in FIG. 8.
Figure 8B:
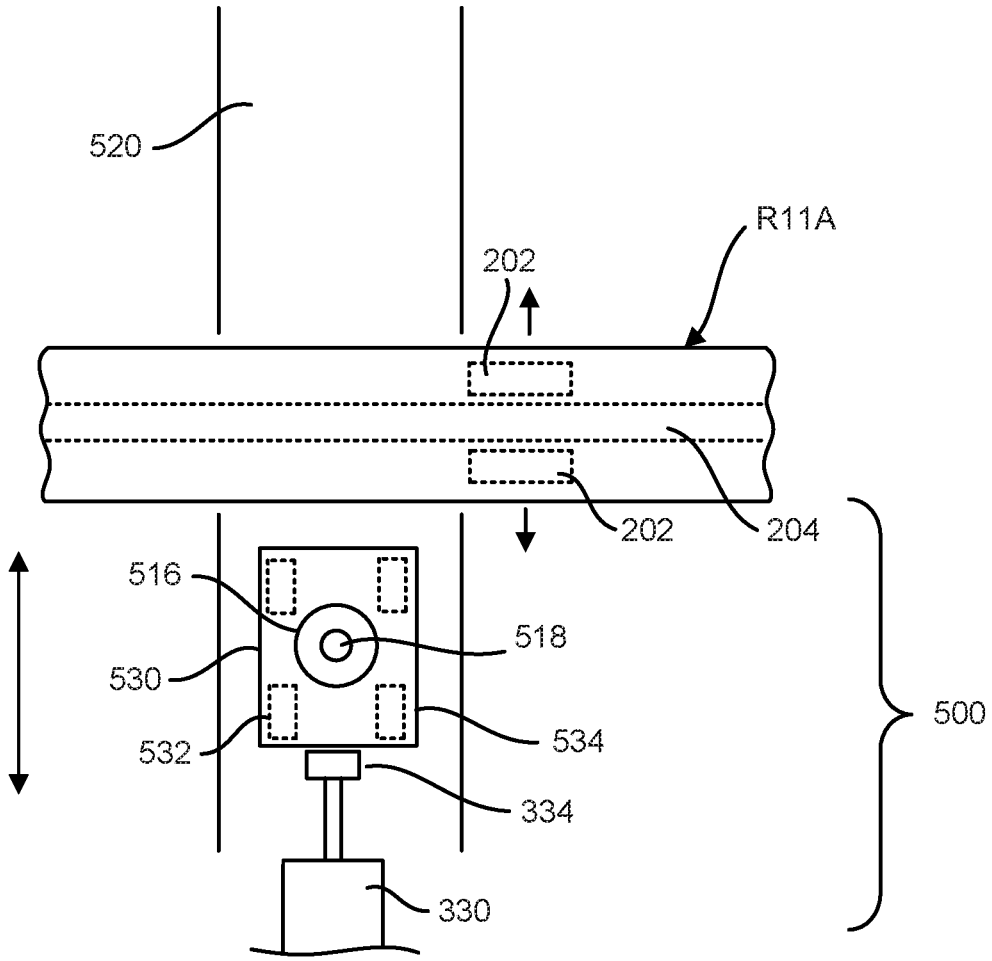
FIG. 8B shows a plan view of the rail segment and cylinder of FIG. 8A.
Figure 8C:
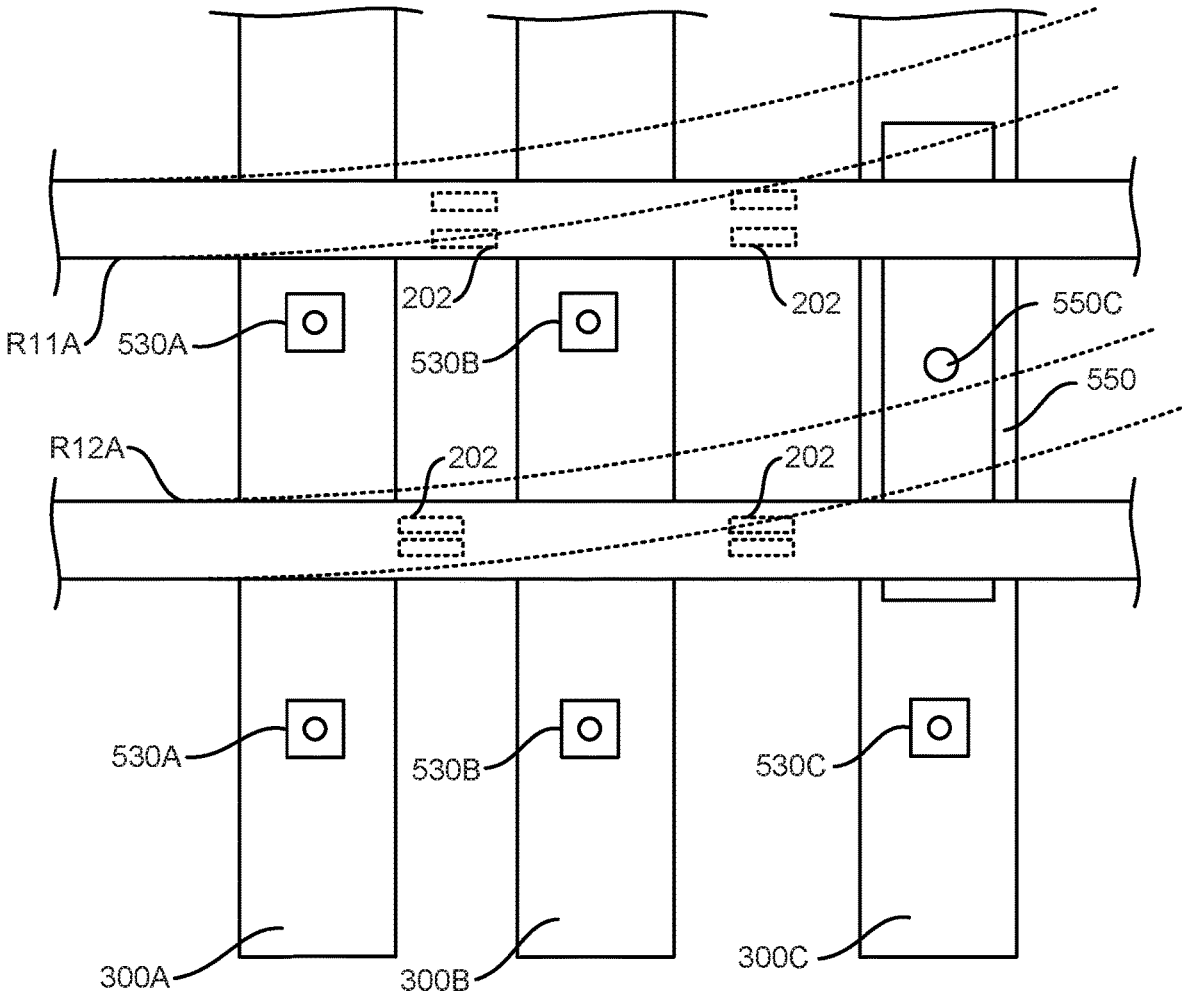
FIG. 8C shows a diagrammatic plan view of a plurality of troughs and trucks with the cylinders of FIGS. 8A and 8B.

The rail segment R11A may be bent from the position shown in FIG. 8B as follows. First, the two pads 202 are pivoted by pivoting mechanism 540 to their second position in which the web 206 is not engaged by the pads 202. Next, the truck 530 is activated to move the cylinder 516 below the rail segment R11A. The piston 518 is then raised until it reaches the bottom of the web 206. Raising the piston 518 further causes the rail segment R11A to rise above the pads 202. The trunk 530 is then moved within the trough 300 to move either in one direction or another thereby moving and bending the rail segment R11A as desired. The position of the piston 518 is controlled by a pneumatic, hydraulic electric line 534 in accordance with commands from command center 150. Several such trucks 530A, 530B, 530C are provided in several troughs 300A, 300B, 300C to selectively bend the rail segments R11A, R12A as required. Within each trough a truck 530 may be provided for each rail segment R11A, R12A, or a movable tie 550 may be provided between the piston 518 and the webs of each rail segment whereby both rail segments R11A, R12A are moved and bent along each trough 300C by a single truck 530C. In this latter case, truck 530C is not moved under the web 206 of one of the rail segments, but instead is moved to the center point 550C of the tie 550 shown in FIG. 8C.

Figure 9A:
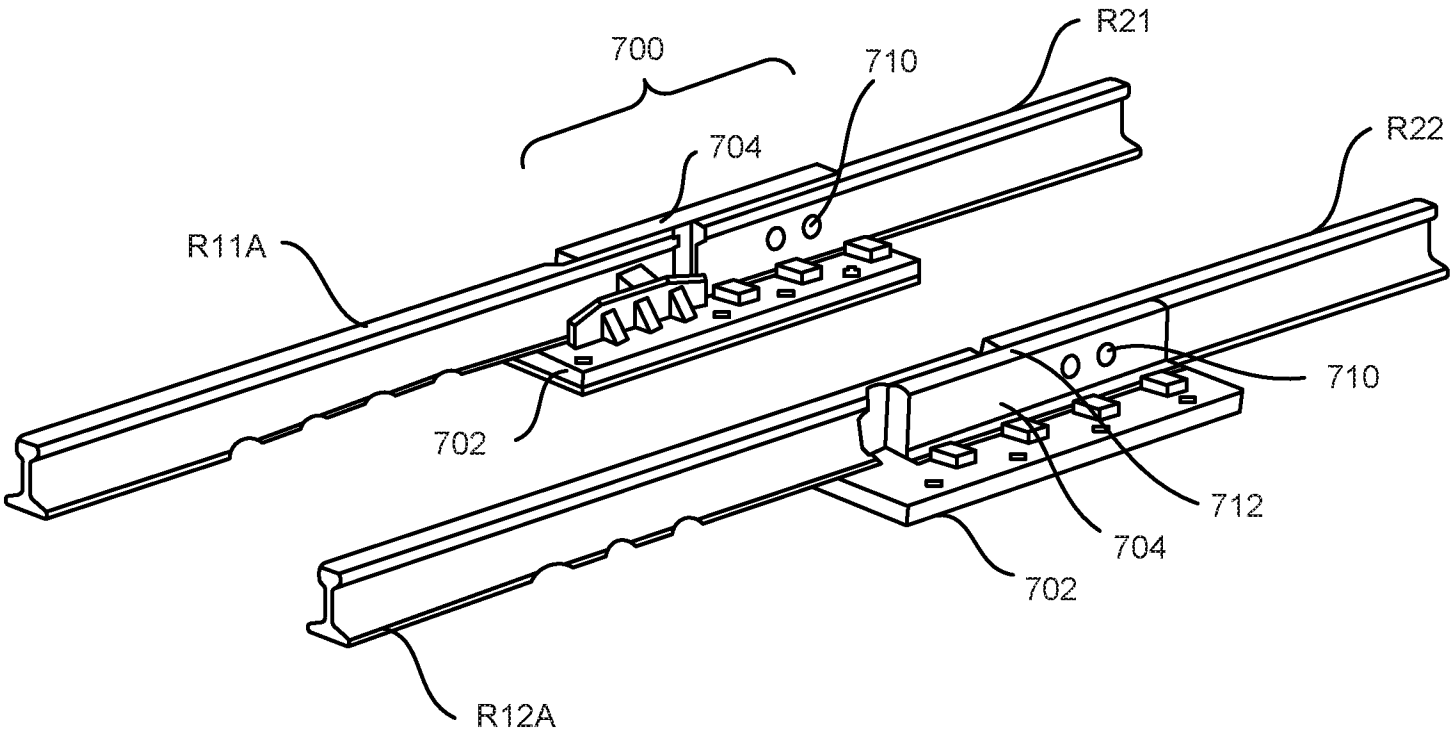
FIG. 9A shows a diagrammatic orthogonal view of a connection with a rider rail.
Figure 9B:
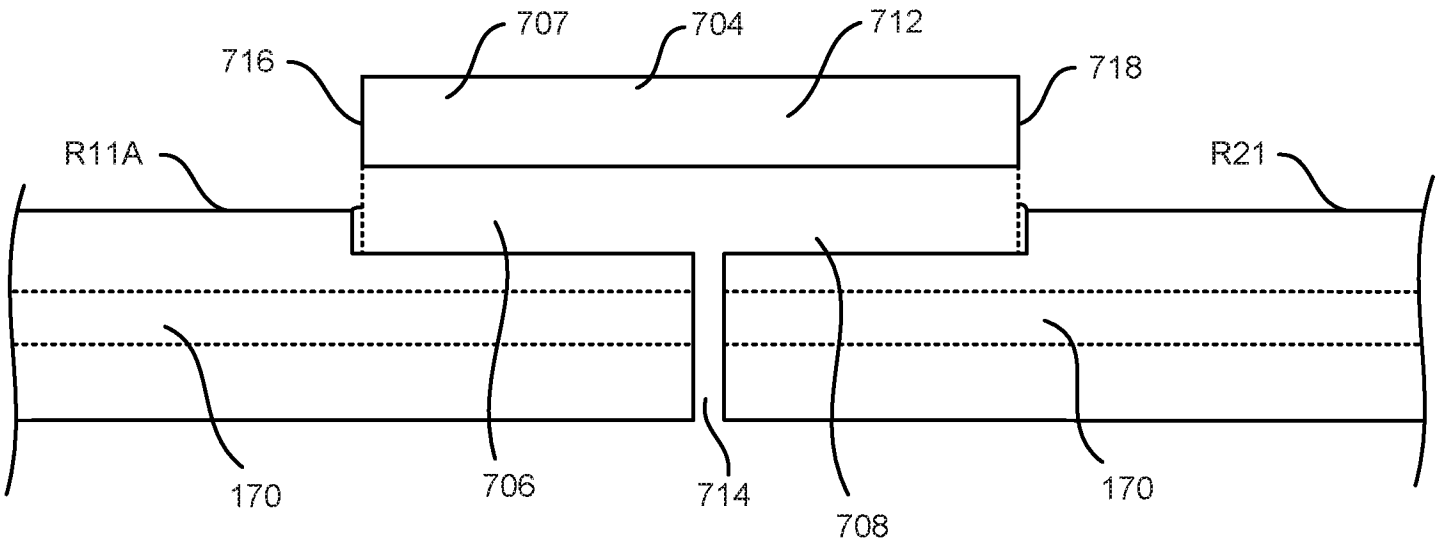
FIG. 9B shows an enlarged plan view of one of the rails and rail segments of the connection illustrated in FIG. 9A.

FIG. 9 depicts an embodiment of a rider rail arrangement, such as the one disclosed in U.S. Pat. No. 6,000,024 that has been modified for the purposes of this invention. In FIGS. 8A, 8B, rails R21, R22 are connected to rail segments R11A, R12A using two connections 700. The rails R21, R22 and rail segments R11A, R12A are supported at the connection by a stationary plate 702. The rails R21, R22, rail segments R11A, R12A and the plate 702 may rest on ties that are not shown in the Figures for the sake of clarity. The plate 702 may also support a guide shoe 706 for aligning the rails and rail segments. Each rail and rail segment has a web 170.

At each of the connections 700, a portion 706, 708 of the rail crown of segments R11A, R12A and R21, R22 is cut away to make room for a rider rail 704. The rider rails 706 are secured to the stationary rails R21, R22 by transversal bolts or other conventional means. The top surface 707 of rider rail 704 is not completely flat is somewhat curved so that its center disposed at a gap 714 between the rail R21 and rail segment R11A is higher than at the longitudinal ends 716, 718 of the rail 704. Importantly, in AN embodiment, the rider rails 704 are affixed to the rails R21 R22 so that their points 712 are above the respective top surfaces of the rails and rail surfaces immediately adjacent to the rider rail. However, preferably, the surfaces 707 near the ends 716, 718 are below the top rail and rail segment surfaces.

In the present invention, rails R21, R22 are stationary and the ends of rail segments R11A, R12A are bent towards or away from the rails R21, 22 as described above. More specifically, in one position of the rail segments, their ends are positioned so they abut the ends of rails 21, R22. As shown in FIG. 8A, in this position, the rider rail is in close proximity to and may even contact the side portions 720. Because of the shape of the rider rails, the wheels of a passing train, go slightly up on the surface 707 and then down to the top surfaces of the rails and rail segments, thereby avoiding riding over the gap 714.

The rail segments R11A, R12A are either moved away horizontally from the ends of rails R21, R22 thus breaking the connection 700, or can be lifted over the rider rails, using the mechanisms described in FIG. 7.

To summarize, FIG. 2 generically shows the principles of the present invention. Nominally the swing turnout is configured so that trains can go back and forth over the first and second tracks TK1 and TK2. To switch trains from the first track TK1 to the third track TK3 (or vice versa) a movable or mobile portion of the first track TK1 is disconnected from the second track TK2 and bent in a continuous and smooth curve until its end abuts the end of the third track TK3. Several configurations are presented for selectively connecting the first track TK1 to any one of the other tracks. In some of the embodiments, the rail segments of the movable or mobile portion can also be raised or lowered to provide banking or to meet tracks disposed at other heights. The mechanical or electromechanical actuators are used to selectively bend the movable portion between the various track ends using a central control board. In the description above, the movable portion of the first track TK1 is described as being continuous with the first track TK1 in the sense there are no gaps in the rails, such as the gaps normally found in conventional turnouts. However, the first track TK1 may have a splice at the junction were the movable portion starts, if necessary. The swing turnout described herein has numerous advantages over conventional turnouts. Since there are no gaps, the wheels, rails, and ballast is subjected to much less wear and tear. Potential signal dead zones are eliminated. The train movement over the turnout is much smoother, and since the nominal curvature is maintained, the train does need to slow at the turnout. Finally, it is believed that the turnout presented herein can be installed faster and cheaper than conventional turnouts.

Importantly the invention is unique in that wheels are provided a continuous and uninterrupted path, whereas a conventional requires one wheel to transfer from a rail to a switch point, to another rail, across a frog, and back onto another rail. So, it is about a continuous path with the swing turnout compared to a broken/segmented path with a conventional turnout. Further, the rail butt joints/lift joints are located in straight sections of rail where they are not subject to the lateral loads and wear seen by switch points in a conventional turnout.

The foregoing description and accompanying drawings illustrate the principles, exemplary embodiments, and modes of operation of the invention. However, the invention should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that numerous modifications may be made to this invention, without departing from its scope as defined in embodiments above and in the appended claims. For example, instead of ties, the rails, especially in the area of the turnout may be disposed on a solid foundation.

What is claimed is:

1. A railroad turnout for selectively connecting a first track to one of a second track and a third track, the first track including first track rails having first rail ends, the second track including second track rails having second rail ends, and the third track including third track rails having third rail ends, the railroad turnout comprising:

a mobile track portion having mobile rails forming a continuation of the first track rails and terminating at the first rail ends;

actuators configured to bend the mobile track portion between a first position and a second position, in the first position, the first rail ends abut the second rail ends and in the second position, the first rail ends abut the third rail ends; and a lifting device configured to selectively lift at least one of the mobile rails, wherein the lifting device is disposed on a truck and configured to selectively bend the at least one of the mobile rails laterally.

2. The railroad turnout of claim 1, wherein the mobile track portion is disposed on supports securing the mobile rails to a plurality of ties.

3. The railroad turnout of claim 2, wherein the plurality of ties are fixed and the supports are configured to move with respect to the ties as the mobile track portion is bent between the first position and second position.

4. The railroad turnout of claim 2, wherein the ties are configured to move with the mobile track portion.

5. The railroad turnout of claim 1, further comprising a trough disposed below the mobile track portion;

a tie slidably disposed in the trough;

a first clamp securing a first one of the mobile rails to the tie, wherein the first clamp is configured to allow the first one of the mobile rails to slide longitudinally and rotate with respect to the tie;

a second clamp securing a second one of the mobile rails to the tie, wherein the second clamp is configured to allow the second one of the mobile rails to slide longitudinally and rotate with respect to the tie; and an actuator disposed in the trough.

6. The railroad turnout of claim 1, wherein the mobile rails have a T-cross-section.

7. The railroad turnout of claim 1, further comprising a plurality of connections that each connect one of the first rail ends to a corresponding one of the second rail ends or the third rail ends.

8. The railroad turnout of claim 7, wherein each of the connections includes a pin and a cavity arrangement for aligning the first rail ends with the second rail ends when the mobile track portion is in the first position and for aligning the first rail ends with the third rail ends when the mobile track portion is in the second position.

9. The railroad turnout of claim 7, wherein, in a group consisting of one of the first rail ends and a corresponding one of the second rail ends, a first connection from among the plurality of connections includes a boss on one of the rail ends in the group and an extendible cylinder-and-piston assembly associated with the other rail end in the group, the cylinder-and-piston assembly being configured to selectively engage the boss and pull the one of the first rail ends and the corresponding one of the second rail ends in the group toward each other.

10. The railroad turnout of claim 1, further comprising a rider rail overlapping one of the first rail ends with a corresponding one of the second rail ends.

11. The railroad turnout of claim 1, further comprising rods that are connected to the mobile rails and configured to maintain the mobile rails at a predetermined gauge distance at least in the first position and the second position.

12. The railroad turnout of claim 1, further comprising another mobile track portion having mobile rails forming a continuation of the third track rails and terminating at the third rail ends.

13. A railroad turnout for selectively connecting a first rail and a second rail of a first track, respectively, to one of a first rail and a second rail of a second track and a first rail and a second rail of a third track, the first rail and the second rail of the second track having a first track rail end and a second track rail end, respectively, and the first rail and the second rail of the third track each having a first track rail end and a second track rail end, respectively, the turnout comprising:

a mobile track section including a first mobile rail and a second mobile rail, the first mobile rail and the second mobile rail forming continuous extensions of the first rail and the second rail of the first track and terminating in a first mobile rail end and a second mobile rail end, the mobile track section having a first position and a second position, wherein in the first position, the first mobile rail end and the second mobile rail end abut the first track rail end and the second track rail end of the second track, and wherein in the second position, said first mobile rail end and the second mobile rail end abut the first track rail end and the second track rail end of the third track; and a connection mechanism is configured to selectively connect the first mobile rail end with the first track rail end of the second track when the first mobile rail end is in the first position, wherein the connection mechanism includes a boss attached to one of the first mobile rail end and the first track rail end of the second track, and an extendible cylinder-and-piston assembly attached to the other of the first mobile rail end and the first track rail end of the second track, and wherein the cylinder-and-piston assembly is configured to selectively engage the boss and pull the first mobile rail end and the first track rail end of the second track toward each other.

14. The railroad turnout of claim 13, further comprising actuators configured to bend the first mobile rail and the second mobile rail from the first position to the second position and from the second position to the first position.

15. The railroad turnout of claim 14, further comprising a controller controlling the actuators.

16. The railroad turnout of claim 13, further comprising a fourth track that includes a first rail having a first rail end and a second rail having a second rail end, wherein the mobile track section further includes a third position, different from the first position and the second position, wherein, in the third position, the first mobile rail end abuts the first rail end of the first rail of the fourth track and the second mobile rail end abuts the second rail end of the second rail of the fourth track.

17. In a railroad system including a turnout for selectively connecting a first track to one of a second track and a third track, the first track including first track rails with first rail ends, the second track including second track rails with second rail ends, and the third track including third track rails with third rail ends, the turnout comprising:

a mobile track portion having mobile rails forming a continuation of the first track rails and terminating at the first rail ends; and actuators configured to bend the mobile track portion between a first position and a second position, in the first position, the first rail ends abut the second rail ends and in the second position, the first rail ends abut the third rail ends, wherein the mobile track portion includes:

a first stationary tie;

a platform disposed on the first stationary tie and configured to be movable longitudinally along the first stationary tie;

a plate disposed on the platform and rotatably engaged with the platform, wherein a first one of the mobile rails of the mobile track portion is disposed on the plate, the first one of the mobile rails having a web; and a first pad affixed to the plate and arranged on a first side of the web, and a second pad affixed to the plate and arranged on a second side of the web, opposite to the first side of the web, a method of switching the first track, the second track and the third track comprising the steps of:

utilizing the actuators to bend the mobile rails of the mobile track portion of the first track to the second position in which the first track is connected to the third track, wherein the bending causes the platform to move longitudinally along the first tie.

18. The method of claim 17, further comprising the step of disconnecting the rail ends of the first track and the second track prior to the bending.

19. The method of claim 17, further comprising the step of connecting the rail ends of the first rail and the second rail of the first track and the third track after the bending.

20. The method of claim 17, further comprising bending the mobile portion from the second position to the first position.

21. The railroad turnout of claim 3, wherein at least one of the supports includes a platform disposed on a first fixed tie at the mobile track portion and configured to be movable longitudinally along the first fixed tie, a plate disposed on the platform and rotatably engaged with the platform, wherein a first one of the mobile rails of the mobile track portion is disposed on the plate, the first one of the mobile rails having a web and a first pad affixed to the plate and arranged on a first side of the web, and a second pad affixed to the plate and arranged on a second side of the web, opposite to the first side of the web.

22. The railroad turnout of claim 21, wherein at least one selected from the group consisting of the first pad and the second pad is separated from the web of the first one of the mobile rails in order to allow the first one of the mobile rails to slide longitudinally relative to the first fixed tie at the mobile track portion.

23. The railroad turnout of claim 5, wherein the tie and the actuator are arranged in-line with one another along a length direction of the trough.

* * * * *